US005524817A

United States Patent [19]

Meier et al.

[11] Patent Number: 5,524,817

[45] Date of Patent: Jun. 11, 1996

[54] DUAL WALLED CONTAINER

[75] Inventors: G. P. Meier, River Hills, Wis.; Michael A. Kipp, Bartlett, Ill.

[73] Assignee: Paper Machinery Corporation, Milwaukee, Wis.

[21] Appl. No.: 416,299

[22] Filed: Apr. 4, 1995

[51] Int. Cl.[6] ..... B65D 3/22

[52] U.S. Cl. ..... 229/403; 220/469; 229/4.5

[58] Field of Search ..... 229/400, 403, 229/4.5; 220/410, 469

[56] References Cited

U.S. PATENT DOCUMENTS

| | | | |
|---|---|---|---|
| Re. 25,618 | 7/1964 | Goodman . | |
| 993,174 | 5/1911 | Kidd . | |
| 1,771,765 | 7/1930 | Benson . | |
| 1,800,759 | 4/1931 | Shean . | |
| 2,266,828 | 12/1941 | Sykes . | |
| 2,287,610 | 6/1942 | Guidry | 229/400 |
| 2,503,045 | 4/1950 | Hamilton | 229/400 |
| 2,591,578 | 4/1952 | McNealy et al. | 229/403 |
| 2,675,954 | 4/1954 | Vogel | 220/469 |
| 2,740,575 | 4/1956 | Fontaine | 229/400 |
| 3,079,027 | 2/1963 | Edwards | 229/400 |
| 3,082,900 | 3/1963 | Goodman . | |
| 3,355,046 | 11/1967 | Jolly . | |
| 3,372,830 | 3/1968 | Edwards | 220/469 |
| 3,443,715 | 5/1969 | Edwards | 220/469 |
| 3,456,860 | 7/1969 | Janninck | 229/400 |
| 3,580,468 | 5/1971 | McDevitt . | |
| 3,737,093 | 6/1973 | Amberg et al. . | |
| 3,759,437 | 9/1973 | Amberg . | |
| 3,850,361 | 11/1974 | Day et al. . | |
| 3,908,523 | 9/1975 | Shikaya . | |
| 4,016,327 | 4/1977 | Fumei et al. | 229/400 |
| 4,018,904 | 4/1977 | Muraoka . | |
| 4,261,501 | 4/1981 | Watkins et al. . | |
| 4,548,348 | 10/1985 | Clements . | |
| 4,551,366 | 11/1985 | Maruhashi et al. . | |
| 4,872,569 | 10/1989 | Bolte . | |
| 5,092,485 | 3/1992 | Lee . | |
| 5,145,107 | 9/1992 | Silver et al. . | |
| 5,205,473 | 4/1993 | Coffin, Sr. . | |
| 5,226,585 | 7/1993 | Varano . | |

*Primary Examiner*—Gary E. Elkins
*Attorney, Agent, or Firm*—Foley & Lardner

[57] ABSTRACT

A dual walled insulating paperboard container is disclosed. The container preferably includes an inner cup and an outer cup each having tapered sidewalls. The sidewalls, however, have different angles of taper to provide an insulating cavity therebetween. Additionally, the bottom of the inner cup is spaced from the bottom of the outer cup to create an insulating barrier along the bottom of the container. The outer cup also includes a stepped region along its top that cooperates with a curled top edge of the inner cup to provide another insulating cavity along the top of the container.

20 Claims, 4 Drawing Sheets

FIG. 1
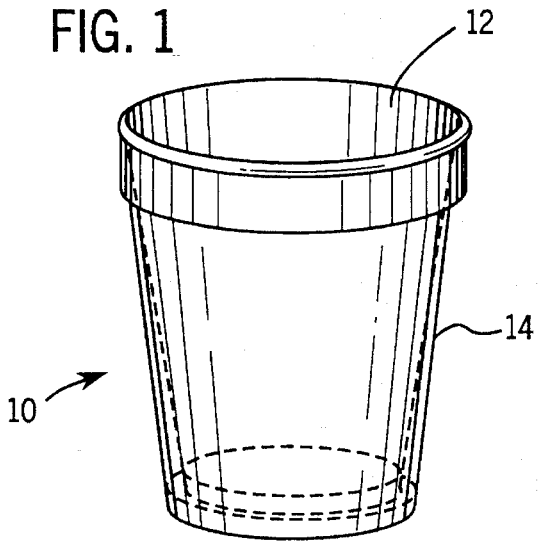
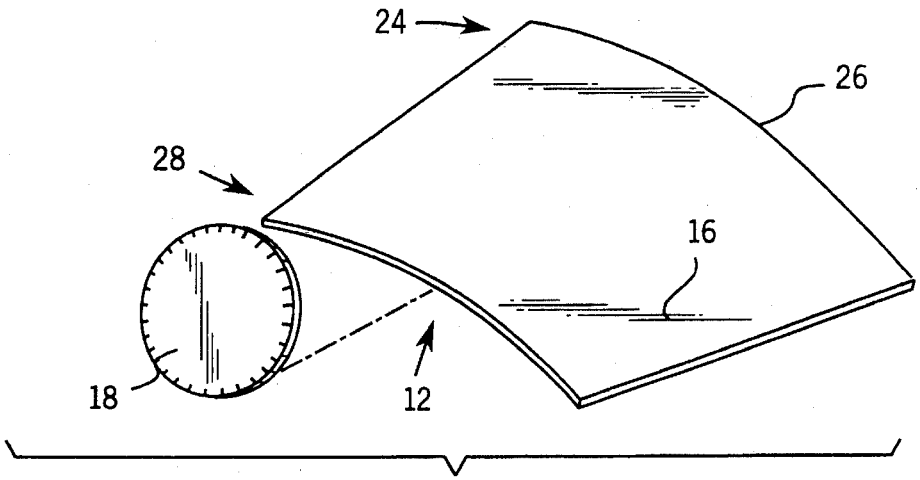
FIG. 2
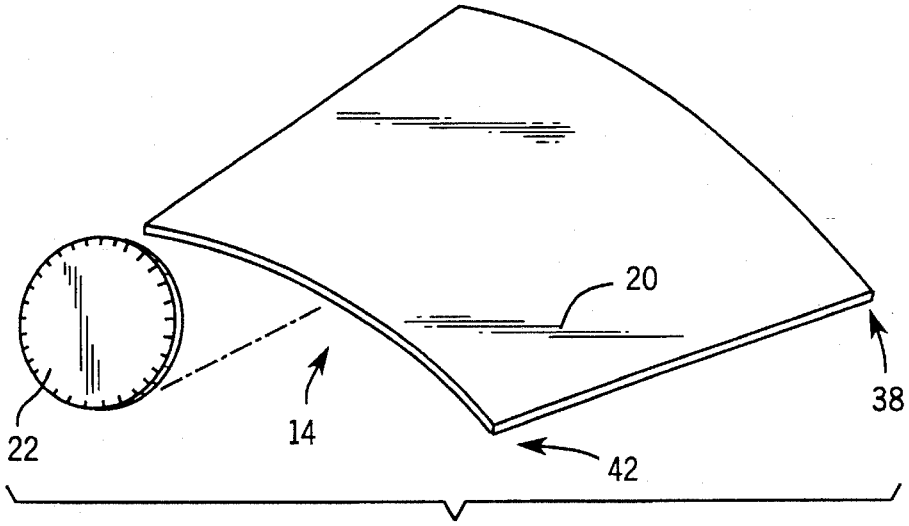
FIG. 3

DUAL WALLED CONTAINER

FIELD OF THE INVENTION

This invention relates generally to a dual walled container having an insulative cavity between the walls, and particularly to a unique dual walled container in which an inner cup is nested within an outer cup and sealed thereto to create an insulative cavity therebetween.

BACKGROUND OF THE INVENTION

A variety of insulative containers have been used to hold hot drinks and hot foods. A typical container is made from polystyrene, such as the cups used to hold coffee or microwavable foodstuffs.

Other containers have dual walled constructions in which an inner container is attached to an outer container to create an intermediate air gap. Still other containers use either an internal or external shell having longitudinal ribs that trap numerous independent air pockets between the ribs and the adjacent container. Those air pockets help insulate the contents of the container from the cooler temperatures of the surrounding air.

The polystyrene containers are problematic because they are not biodegradable. Therefore, many cup manufacturers, suppliers, and users have tried to be more environmentally conscious in choosing materials, such as paperboard. However, conventional paperboard containers, e.g., cups, have not had the insulating qualities of polystyrene. Attempts have been made to create usable dual walled cups made out of various materials, but those containers have proven to be less desirable due to poor insulating qualities or expense of manufacture. Consequently, there is a need for a new style of insulating container able to sufficiently limit the dissipation of heat from its contents, while being relatively inexpensive to manufacture and therefore competitive with traditional polystyrene cups and containers.

SUMMARY OF THE INVENTION

The present invention relates generally to a dual walled container. The container is preferably made of paperboard and includes an inner cup having a sidewall disposed about a central axis. The sidewall has a curled top edge that curls outwardly from the central axis. The inner cup also includes a bottom wall disposed generally transversely to the sidewall.

The container further includes an outer cup having a sidewall and a bottom wall oriented generally transversely to the sidewall. The outer cup sidewall preferably includes a generally straight top edge that extends into proximity with the curled top edge of the inner cup. At least a portion of the inner cup sidewall is spaced from the outer cup sidewall.

According to a more detailed aspect of the invention, the inner cup sidewall is disposed at an acute angle with respect to the central axis. Similarly, the outer cup sidewall is disposed at an acute angle with respect to the central axis. The angle of the inner cup sidewall is greater than the angle of the outer cup sidewall with respect to the central axis. The differing angles of orientation create a cavity between the inner cup sidewall and outer cup sidewall throughout at least a portion of the overall container. This space serves as an insulating boundary to help maintain heat within the contents of the container.

Additionally, the inner cup and outer cup each preferably include a recessed bottom. The recessed bottom of the outer cup facilitates nesting of multiple containers, while allowing for ease of separation. The recessed bottom of the inner cup cooperates with the bottom wall of the outer cup to create an insulating boundary along the bottom of the cup.

The outer cup also preferably includes a stepped region disposed generally towards the top of the cup and extending radially outwardly from the central axis. This stepped region creates another insulative cavity between the inner cup and the outer cup to further enhance the heat retention capabilities of the dual walled container.

BRIEF DESCRIPTION OF THE FIGURES OF THE DRAWING

The invention will hereafter be described with reference to the accompanying drawings, wherein like reference numerals denote like elements, and:

FIG. 1 is a perspective view of the dual walled container according to a preferred embodiment of the invention;

FIG. 2 is an exploded view of the sidewall blank and bottom blank of the inner cup used in the container illustrated in FIG. 1;

FIG. 3 is an exploded view of the sidewall blank and bottom blank of the outer cup of the container illustrated in FIG. 1;

DETAILED DESCRIPTION OF THE PREFERRED EMBODIMENTS

Figure 4:
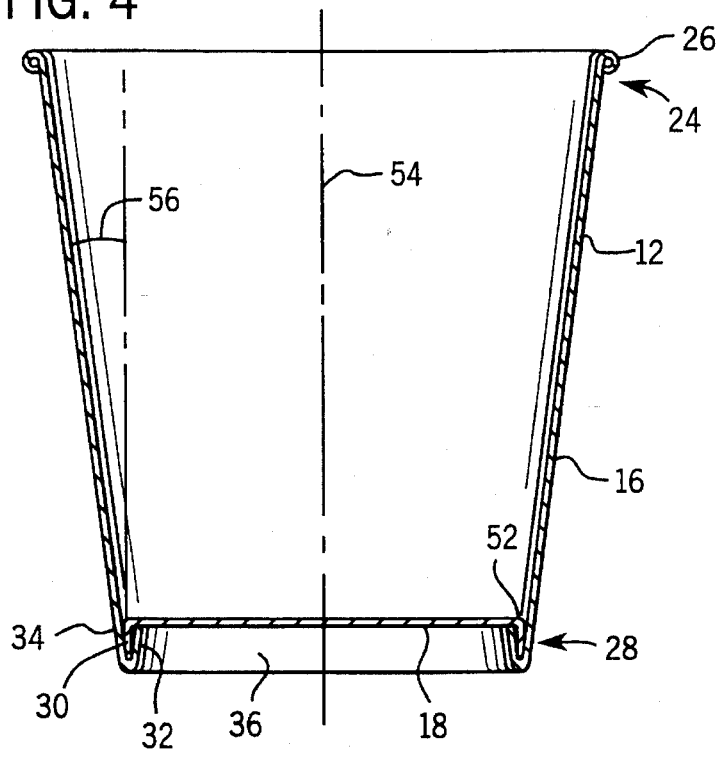
FIG. 4 is a cross-sectional view of the inner cup of the container illustrated in FIG. 1.

Referring generally to FIGS. 1–3, a container 10 having an inner cup 12 and an outer cup 14 is shown. Inner cup 12 includes a sidewall blank 16 that forms its sidewall and a bottom blank 18 that forms its bottom wall as illustrated best in FIG. 2. Similarly, outer cup 14 includes a sidewall blank 20 that forms its sidewall and a bottom wall blank 22 that forms its bottom wall, as best illustrated in FIG. 3.

As shown in FIG. 4, an exemplary inner cup 12 includes an upper region 24 having a curled top edge 26 and a bottom region 28. Sidewall blank 16 is wrapped around bottom blank 18 and disposed generally transversely thereto. Bottom blank 18 is typically bent or folded over in proximity to its outer edge to form a lip 30. The sidewall blank 16 is located with respect to bottom blank 18 so a flap portion 32 of sidewall blank 16 extends beyond lip 30. Flap portion 32 is bent or folded around lip 30 so lip 30 may be squeezed between flap portion 32 and a lower region 34 of sidewall blank 16 (see also FIG. 5A which shows the similar construction of the preferred bottom of outer cup 14). By forming inner cup 12 as illustrated in FIG. 4, a recessed bottom area 36 is created in the bottom of inner cup 12 on an opposite side of bottom blank 18 from the food or drink containing area of cup 12.

Figure 5:
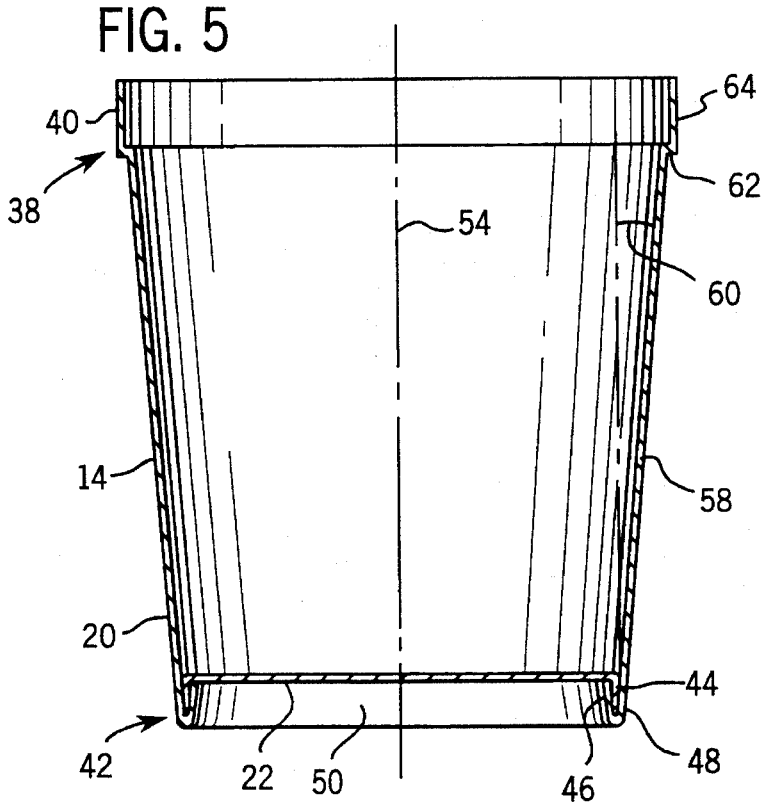
FIG. 5 is a cross-sectional view of the outer cup of the container illustrated in FIG. 1.
Figure 5A:
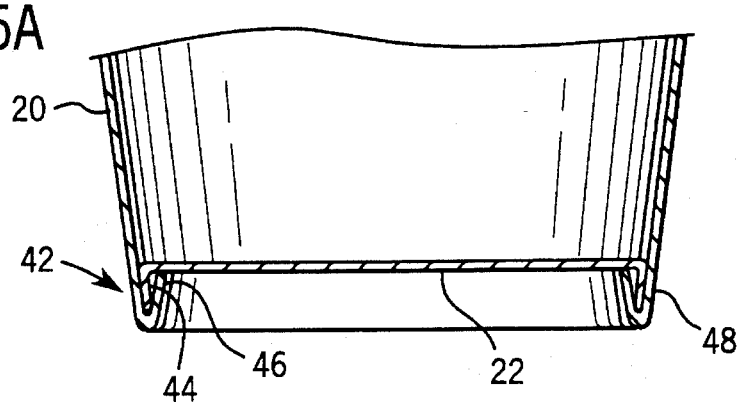
FIG. 5A is a cross-sectional view of the bottom area of the outer cup of the container illustrated in FIG. 1.

Similarly, as shown in FIGS. 5 and 5A outer cup 14 includes an upper region 38 preferably having a longitudinally straight top edge 40 and a bottom region 42. Outer cup sidewall blank 20 is wrapped around bottom blank 22 and disposed generally transversely thereto. Outer cup bottom blank 22 is typically bent or folded over in proximity to its outer edge to form a lip 44. The sidewall blank 20 is located with respect to bottom blank 22 so a flap portion 46 of sidewall blank 20 extends beyond lip 44. Flap portion 46 is bent or folded around lip 44 so lip 44 may be squeezed between flap portion 46 and a lower region 48 of sidewall blank 20. By forming outer cup 14 as illustrated in FIGS. 5 and 5A, a recessed bottom area 50 is created in the bottom of outer cup 14 on an opposite side of bottom blank 22 from the main container body of outer cup 14.

Figure 7:
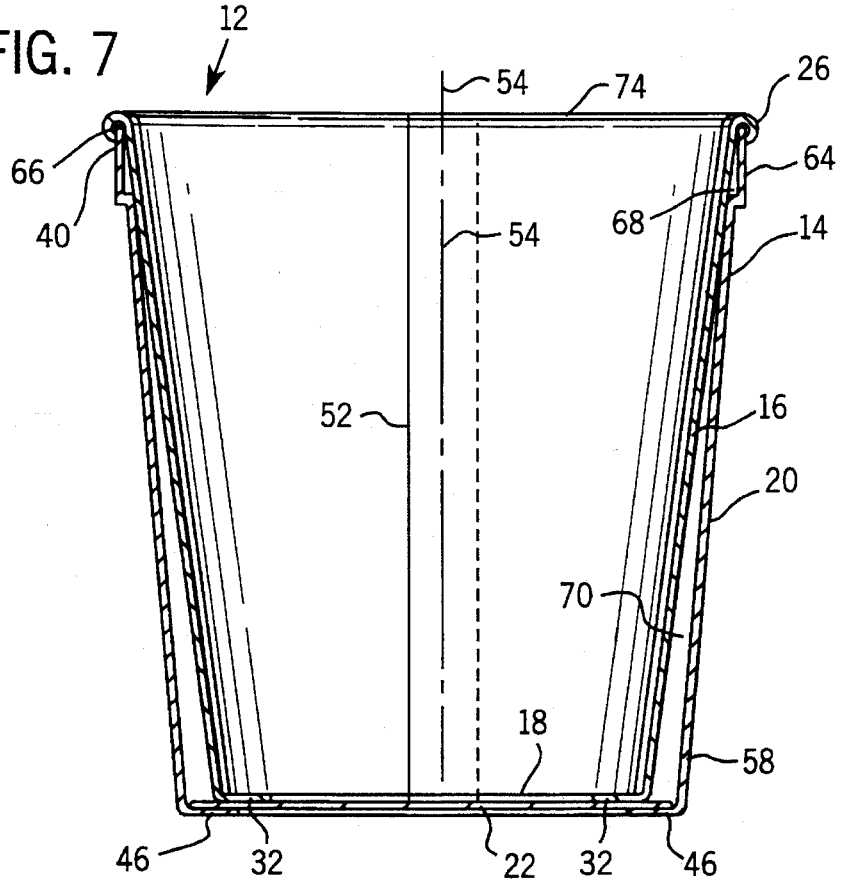
FIG. 7 illustrates an alternate embodiment of a container according to an embodiment of the invention in which the cups have flat bottoms.

Alternatively, inner cup 12 and outer cup 14 can be formed with generally flat bottoms where the flap portions are folded to a generally horizontal position and sealed to the bottom blanks. (See FIG. 7 showing alternate flat bottom configuration.) Also, either the inner cup 12 or outer cup 14 can be formed with a recessed bottom, while the other cup is formed with a flat or other type of bottom. For example, the outer cup 14 could be formed with a generally flat bottom while the inner cup 12 is formed with a recessed bottom to preserve an insulating boundary between the cup bottoms when the inner cup 12 is inserted into the outer cup 14.

Figure 6:
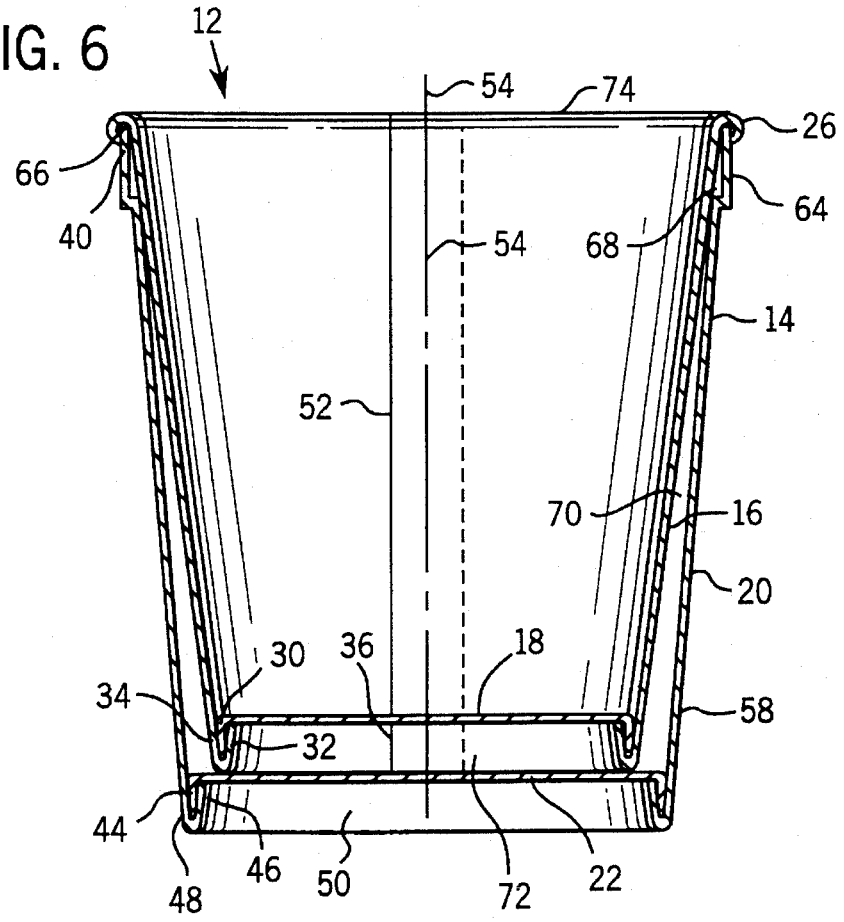
FIG. 6 is a cross-sectional view of the overall container illustrated in FIG. 1 and showing the inner cup disposed within the outer cup to provide an insulated container.

Inner cup 12 and outer cup 14 are preferably made from paperboard blanks having a thermoplastic coating, such as polypropylene. The thermoplastic material permits heating and sealing of adjacent components. For example, when inner cup sidewall blank 16 is wrapped around inner cup bottom blank 18, the adjacent edges of sidewall blank 16 are heated and pressed together to form a seal 52 (FIG. 6). Similarly, lip 30, flap portion 32, and lower region 34 may be heated and pressed together to form a strong, leak-proof bottom region 28. This same approach may be used in the assembly of outer cup 14.

Inner cup 12 and outer cup 14 may be made from the same grades of paperboard. However, because the outer cup 14 does not hold ingestible products, it may also be made of recycled or generally lesser grade paperboard. Typically, the sidewall blank and bottom blank of each cup are made from similar grades of paperboard, although differing grades could also be used for those elements as well.

Inner cup 12 is disposed about a central axis 54 that extends generally perpendicularly through the center of bottom blank 18. Preferably, when sidewall blank 16 is wrapped around bottom blank 18, sidewall 16 is disposed at an acute angle 56 with respect to central axis 54 (see FIG. 4). Angle 56 can be increased or decreased for a specific application, but is preferably in the range from 5 to 10 degrees, and most preferably approximately 7.5 degrees.

Figure 8:
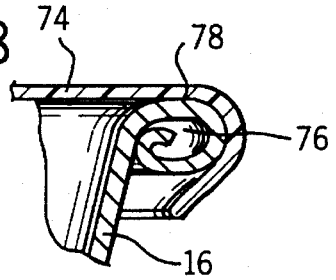
FIG. 8 illustrates the curled top edge of an inner cup according to the preferred embodiment of the invention.

Inner cup 12 also includes curled top edge 26 that is formed by rolling or curling the top of sidewall blank 20 initially away from central axis 54 and then around and back towards the remaining portion of sidewall blank 16. Preferably, the curl extends through 180° or more, and as illustrated, can curl through 360° back to the remaining portion of sidewall blank 16 to form a generally circular cross-section as illustrated in FIGS. 4 and 8.

Outer cup 14 includes longitudinally straight top edge 40 that extends into proximity with curled top edge 26 when inner cup 12 is combined with outer cup 14 as illustrated in FIG. 6. Straight top edge 40 is longitudinally straight in that it does not have any substantial outward curl away from central axis 54. However, straight edge 40 could have undulations or variations that do not interfere with the nesting of inner cup 12 and outer cup 14.

Additionally, the sidewall 20 of outer cup 14 includes a tapered region 58 that forms an acute angle 60 with central axis 54 when inner cup 12 and outer cup 14 are combined. Angle 60 is typically less than angle 56 and preferably in the range from 2 to 6 degrees, and most preferably approximately 4 degrees. Tapered region 58 spans generally from flap portion 46 to a step 62 that extends generally outwardly from central axis 54. A generally straight or vertical section 64 extends from step 62 to top edge 40 of outer cup 14. Preferably, straight section 64 is generally parallel with central axis 54 when inner cup 12 and outer cup 14 are connected together.

Inner cup 12 may be connected to outer cup 14 by a fastener, such as an adhesive 66, e.g. hot melt glue, placed between the inside of straight section 64 and the outside of inner cup sidewall 16. However, adhesive or other fasteners could be applied at other locations, such as between the bottoms of the inner and outer cups. Additionally, inner cup 12 and outer cup 14 may be fastened together without adhesive. For instance, they may be fastened together by a friction fit. When inner cup 12 and outer cup 14 are fastened together, an upper cavity 68 is formed between straight section 64, step 62, and inner cup sidewall 16. Additionally, a cavity 70 is formed between tapered region 58 of outer cup 14 and sidewall blank 16 of inner cup 12 due to the differing acute angles 56 and 60. Cavity 70 preferably extends for 360 degrees around the circumference of inner cup 12. Also, a bottom cavity 72 is created between inner cup bottom blank 18 and outer cup bottom blank 22 as air is trapped in recessed bottom area 36. Thus, upper cavity 68, cavity 70, and bottom cavity 72 cooperate to provide container 10 with substantial insulating ability.

A membrane or cover 74 is preferably attached to curled top edge 26 when container 10 is filled with product. Membrane 74 may be a flexible material, such as film, coated paper or foil, heat sealed to curled top edge 26. Sometimes, a better seal is obtained if the circular cross-section of top edge 26 is elongated to provide more surface area to which membrane 74 is attached.

Figure 9:
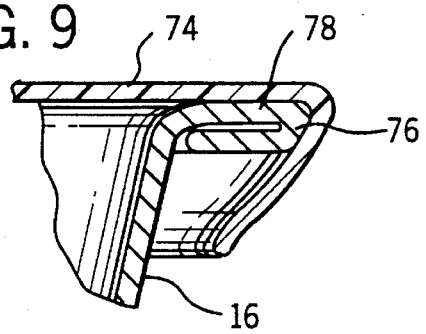
FIG. 9 illustrates an alternate embodiment of the curled top edge of an inner cup according to one embodiment of the invention.

As shown in FIG. 9, an alternate embodiment of curled top edge 26 designated by the reference numeral 76 is illustrated. In this embodiment, the curled top edge 76 is elongated and the elongated portion extends generally outwardly from central axis 54. This provides an expanded top surface 78 of curled top edge 76 to which membrane 74 is attached.

It will be understood that the foregoing description is of a preferred exemplary embodiment of this invention and that the invention is not limited to the specific forms shown. For example, various grades of paperboard and other materials may be used in the construction of either the inner cup or the outer cup; the inner and outer cups may each be provided with recessed bottoms or bottoms of other configurations; the curled top edge of the inner cup can have a variety of configurations; the outer cup can have straight or tapered sidewall or sidewall sections; the inner cup can have varying degrees of taper to its sidewall; and the cups can have circular, elliptical, rectangular, or other cross-sectional shapes depending on the overall shape of the container. These and other modifications may be made in the design and arrangement of the elements without departing from the scope of the invention as expressed in the appended claims.

What is claimed is:

1. A dual walled cup, comprising:

an inner cup having an inner cup sidewall disposed about a central axis and an inner cup bottom wall disposed generally transversely to the inner cup sidewall, the inner cup sidewall having a top edge curled outwardly from the central axis; and an outer cup having an outer cup sidewall and an outer cup bottom wall disposed generally transversely to the outer cup sidewall, the outer cup sidewall having a generally straight top edge around which the top edge of the inner cup is curled, wherein at least a portion of the inner cup sidewall is spaced from the outer cup sidewall, and the inner cup sidewall and outer cup sidewall comprise paperboard, further wherein the outer cup sidewall includes a step that extends radially outward from the central axis to at least partially form an upper cavity disposed intermediate the step and the generally straight top edge.

2. The dual walled cup as recited in claim 1, wherein the inner cup sidewall is spaced from the outer cup sidewall through 360° about a circumference of the inner cup.

3. A dual walled cup, comprising:

an inner cup having an inner cup sidewall disposed about a central axis and an inner cup bottom wall disposed generally transversely to the inner cup sidewall, the inner cup sidewall having a top edge curled outwardly from the central axis;

an outer cup having an outer cup sidewall and an outer cup bottom wall disposed generally transversely to the outer cup sidewall, the outer cup sidewall having a generally straight top edge around which the top edge of the inner cup is curled, wherein at least a portion of the inner cup sidewall is spaced from the outer cup sidewall, and the inner cup sidewall and outer cup sidewall comprise paperboard;

wherein the inner cup sidewall is spaced from the outer cup sidewall through 360° about a circumference of the inner cup and the curled top edge is generally circular in cross-section and is curled through at least 360°.

4. A dual walled cup, comprising:

an inner cup having an inner cup sidewall disposed about a central axis and an inner cup bottom wall disposed generally transversely to the inner cup sidewall, the inner cup sidewall having a top edge curled outwardly from the central axis;

an outer cup having an outer cup sidewall and an outer cup bottom wall disposed generally transversely to the outer cup sidewall, the outer cup sidewall having a generally straight top edge around which the top edge of the inner cup is curled, wherein at least a portion of the inner cup sidewall is spaced from the outer cup sidewall, and the inner cup sidewall and outer cup sidewall comprise paperboard;

wherein the inner cup sidewall is spaced from the outer cup sidewall through 360° about a circumference of the inner cup and the curled top edge is elongated in a direction generally outwardly from the central axis.

5. A dual walled cup, comprising:

an inner cup having an inner cup sidewall disposed about a central axis and an inner cup bottom wall disposed generally transversely to the inner cup sidewall, the inner cup sidewall having a top edge curled outwardly from the central axis;

an outer cup having an outer cup sidewall and an outer cup bottom wall disposed generally transversely to the outer cup sidewall, the outer cup sidewall having a generally straight top edge around which the top edge of the inner cup is curled, wherein at least a portion of the inner cup sidewall is spaced from the outer cup sidewall, and the inner cup sidewall and outer cup sidewall comprise paperboard;

wherein the inner cup bottom wall and inner cup sidewall cooperate to form a recessed bottom.

6. The dual walled cup as recited in claim 5, wherein the outer cup bottom wall and outer cup sidewall cooperate to form a recessed bottom.

7. The dual walled cup as recited in claim 6, wherein the inner cup sidewall includes a bottom edge disposed on an opposite side of the inner cup bottom wall from the top edge.

8. The dual walled cup as recited in claim 6, wherein the inner cup sidewall is tapered at a first angle with respect to the central axis and the outer cup sidewall includes a region tapered at a second angle with respect to the central axis, the first angle being larger than the second angle.

9. The dual walled cup as recited in claim 8, wherein the inner cup sidewall is of the same thickness as the outer cup sidewall.

10. The dual walled cup as recited in claim 8, wherein the outer cup sidewall includes a step that extends radially outwardly from the central axis, the step being disposed between the tapered region and the top edge.

11. The dual walled cup as recited in claim 10, wherein the outer cup sidewall includes a straight segment extending between the step and the top edge, the straight segment being aligned generally parallel with the central axis.

12. The dual walled cup as recited in claim 11, further comprising an adhesive disposed between the inner cup sidewall and the outer cup sidewall generally along the inside of the straight segment.

13. The dual walled cup as recited in claim 12, wherein the outer cup comprises recycled paperboard.

14. The dual walled cup as recited in claim 6, further comprising a membrane sealed over the curled top edge of the inner cup to enclose the inner cup.

15. A dual walled container, comprising:

an outer cup including a central axis, an outer cup bottom generally perpendicular to the central axis, and an outer cup sidewall;

an inner cup including an inner cup bottom generally perpendicular to the central axis, and an inner cup sidewall;

wherein the inner cup bottom includes a central portion and an outer lip folded generally transversely to the central portion and the inner cup sidewall includes a curled top edge having a curl that extends through at least 180°, the inner cup sidewall further including a bottom flap folded over the outer lip and sealed thereto to create a recessed bottom;

the outer cup sidewall having a top edge that extends into proximity with the curled top edge, the outer cup and inner cup being attached to one another to create an insulated cavity therebetween, the outer cup and inner cup comprising a paperboard material.

16. The dual walled container as recited in claim 15, wherein the inner cup and outer cup are made from different grades of paperboard material.

17. The dual walled container as recited in claim 15, wherein the outer cup bottom includes a central portion and an outer lip folded generally transversely to the central portion, the outer cup sidewall including a bottom flap folded over the outer lip of the outer cup bottom to create a recessed bottom in the outer cup.

18. The dual walled container as recited in claim 15, wherein the inner cup sidewall is tapered at a first angle with respect to the central axis and the outer cup sidewall includes a tapered lower portion disposed at a second angle with respect to the central axis, a step portion extending radially outwardly from the central axis, and an upper portion generally aligned with the central axis.

19. The dual walled container as recited in claim 18, wherein the upper portion is adhered to the inner cup sidewall.

20. The dual walled container as recited in claim 19, wherein the outer cup includes a recessed bottom.

* * * * *